US005520750A

United States Patent [19]

Riley

[11] Patent Number: 5,520,750

[45] Date of Patent: May 28, 1996

[54] ANTI CORROSION TREATMENT OF ALUMINIUM OR ALUMINIUM ALLOY SURFACES

[75] Inventor: Peter J. Riley, Oak Flats, Australia

[73] Assignee: BHP Steel (JLA) Pty. Ltd., Melbourne, Australia

[21] Appl. No.: 424,513

[22] PCT Filed: Nov. 23, 1993

[86] PCT No.: PCT/AU93/00594

§ 371 Date: May 23, 1995

§ 102(e) Date: May 23, 1995

[87] PCT Pub. No.: WO94/12687

PCT Pub. Date: Jun. 9, 1994

[30] Foreign Application Priority Data

Nov. 26, 1992 [AU] Australia ..... PL6051

[51] Int. Cl.[6] ..... C23C 22/42

[52] U.S. Cl. ..... 148/261; 148/273; 148/275

[58] Field of Search ..... 148/261, 273, 148/275

[56] References Cited

U.S. PATENT DOCUMENTS

| | | | |
|---|---|---|---|
| 3,945,899 | 3/1976 | Nikaido et al. | 204/181 |
| 3,962,061 | 7/1976 | Nikaido et al. | 204/181 |
| 4,148,670 | 4/1979 | Kelly | 148/6.15 |
| 4,233,088 | 11/1980 | Kronstein | 148/6.16 |
| 4,264,378 | 4/1981 | Oppen et al. | 148/6.15 |
| 4,385,940 | 5/1995 | Kirihara | 148/261 |

FOREIGN PATENT DOCUMENTS

| | | |
|---|---|---|
| 8063/75 | 9/1977 | Australia . |
| 22855/92 | 3/1993 | Australia . |
| 0305560 | 3/1989 | European Pat. Off. . |
| 0337075 | 10/1989 | European Pat. Off. . |
| 1198546 | 7/1970 | United Kingdom . |

OTHER PUBLICATIONS

Derwent Abstract Accession No. 92-312635/38.
Derwent Abstract Accession No. 74460.
Derwent Abstract Accession No. 249388/13.

*Primary Examiner*—Sam Silverberg
*Attorney, Agent, or Firm*—Nikaido, Marmelstein, Murray & Oram

[57] ABSTRACT

An anti corrosion treatment of an aluminium or aluminium alloy surface comprising the steps of treating the surface with a solution having a pH of from greater than 0 to less than 2 and comprising at least one metal oxo ion completed with phosphorus (V) wherein the metal oxo ion is vanadate or tungstate or a mixture thereof.

9 Claims, 1 Drawing Sheet

ANTI CORROSION TREATMENT OF ALUMINIUM OR ALUMINIUM ALLOY SURFACES

TECHNICAL FIELD

This invention relates to anti corrosion treatment of aluminium or aluminium alloy surfaces. In particular, the present invention relates to an anti corrosion treatment of metal coated steel having an aluminium or aluminium alloy surface.

BACKGROUND ART

Zinc, aluminium and/or combinations of aluminium and zinc (Al/Zn), are widely used as surface coatings, particularly but not exclusively for steel for protection against rust and corrosion. In practice, however, the zinc or Al/Zn coatings are susceptible to white rust or black rust respectively when exposed to the atmosphere due to reactions with moisture. Such rust is detrimental to the surface and generally makes coated steel substrates unsaleable despite the fact that the overall service life of the coated steel may remain the same and the formation of rust generally interferes with finishing operations. The ability to resist such corrosion is referred to herein as wet stack performance.

In order to inhibit the formation of rust on coated surfaces it is generally accepted that the treatment of a surface with a chromate imparts anti corrosive properties and this type of treatment is generally referred to as chromate passivation. However chromate is highly toxic to exposed workers and due to its high toxicity, disposal of chromium residues is difficult. Further in various markets the yellow discolouration of the treated coated surfaces is considered to be an unacceptable product attribute.

In order to overcome the problems associated with chromate passivation, phosphate coatings have been used. However the anticorrosion properties of phosphate have been found to be far inferior to the above mentioned chromate treatment.

U.K. Patent Application No. 2,070,073 discloses an anti corrosive treatment for preventing white rust on galvanized steel comprising applying to the surface of a galvanized steel sheet an acidic solution containing molybdic acid or a molybdate in a concentration of 10–200 g/l calculated as molybdenum and adjusted to a pH of 1 to 6 by addition of an organic or inorganic acid. However, it has been found that the corrosion resistance of aluminium and aluminium alloy surfaces treated with the above solution is inferior to the chromate treated substrates under certain conditions and the treated surfaces suffer from an undesirable degree of discolouration. Moreover modybdate treated surfaces have been shown to change from a pale yellow/blue to a strong green colour when stored for periods of time in excess of 24 hours.

Accordingly it is an object of the present invention to provide means for avoiding and/or ameliorating at least some of the above discussed disadvantages of the prior art.

DISCLOSURE OF THE INVENTION

According to one aspect, the present invention consists in an anti corrosion treatment of an aluminium or aluminium alloy surface comprising treating said surface with a solution having a pH of from 0 to 2 and comprising at least one metal oxo ion complexed with phosphorous (V) wherein the metal oxo ion is vanadium or tungsten or a mixture thereof.

Surprisingly, it has been found that the treated aluminium or aluminium alloy surfaces of the present invention provide substantial advantages over the prior art. In particular the vanadate and tungstate treating solution of the present invention provides improved high temperature corrosion resistance and reduce discolouration of the treated surface.

Ammonium and alkali metal salts such as ammonium vanadate and tungstate or sodium vanadate and tungstate are generally the preferred source of the metal oxo ion. Preferably the metal oxo ion is present in a concentration from 10 to 100 g/l and more preferably from 10 to 60 g/l.

In a highly preferred embodiment of the present invention, typically aluminium etching agents are employed during the treating step. Preferred etching agents are those containing at least one fluoride containing compound such as sodium fluoride and sodium tetrafluoroborate. Desirably between 0.4 g/l and 1.5 g/l of fluoride and more preferably between 0.4 to 0.7 g/l is used.

Phosphoric acid is the preferred source of phosphorus (V) and the concentration of the phosphoric acid used in the present invention is generally from 10% (1.5M) to 50% (7.5M).

Preferably the aluminium or aluminium surface is coated by dipping the surface to be treated into a containing the solution but the desired surface may be treated by other means such as roller coating, spraying, or the like.

Accordingly to a second aspect, the present invention relates to a composition for anti corrosion treatment of an aluminium or aluminium alloy surfaces comprising the steps of treating the surface with a solution having a pH of from 0 to 2 and wherein said solution comprises:

(1) at least one metal oxo ion complexed with phosphorus (V) wherein the metal oxo ion is vanadium or tungsten or mixtures thereof and (2) at least one aluminium or aluminium alloy etching agent.

It has been found that the anti corrosive property of the solution according to the present invention becomes deficient at pH above 2 and as such the pH of the acidified solution according to the present invention is preferably lower than 2 and more preferably between 1 and 1.5. The pH of the solution according to the present invention is adjusted by the addition of the phosphoric acid.

The bath temperature of the resulting anti corrosion solution of the present invention should be such that the reactive ingredients of the acidic solution bond to the metal surface and generally the bath is maintained between 20° to 80° C. Higher bath temperatures are advantageous for the chemical reaction and the subsequent drying, but bath temperatures of 30° to 60° C. are preferred as too high temperature results in an increase of acid vaporization. The contact time of the substrate in the bath is preferably about 1 second or less.

Preferred embodiments of the invention will now be described by way of example only with reference to the following examples:

BEST MODE OF CARRYING OUT THE INVENTION

EXAMPLE 1

Figure 1:
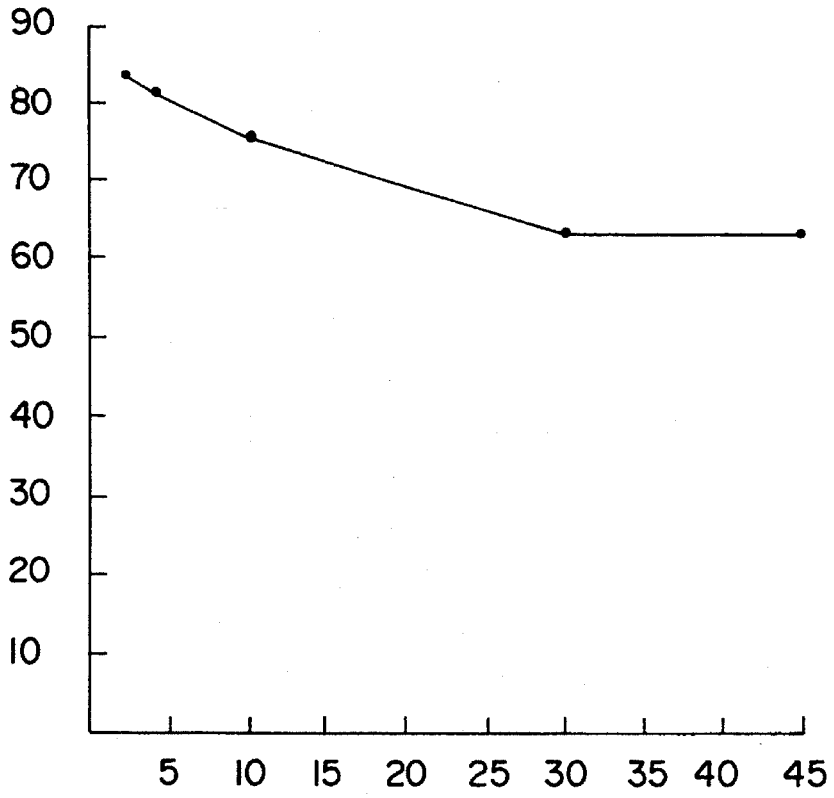
FIG. 1 is a plot of the discolouration vs contact time for phosphate/vanadate passivation treatment.

Effect of Contact Time and Temperature on Vanadate/Phosphate Passivation Efficiency A bath containing ammonium vanadate (23.4 g in 5 liters water; 0.04M) sodium fluoride (1.42 g/l 0.34M) was acidified with phosphoric acid (900 ml; 2.7M) until the pH of the bath containing the ammonium vanadate and sodium fluoride reached 1.5. A strip of aluminium (53%)/zinc (45%) coated steel was then dipped into the bath for varying contact time at different passivation temperatures. The results of the resulting coating film are given in Tables 1 to 3.

TABLE 1

| Passivation Temperature °C. | Contact Time | Corrosion resistance (in wet stack test @ 40° C.) |
|---|---|---|
| 40 | 2 | <5% black rust on sample after 8 weeks testing |
| | 4 | <5% black rust on sample after 8 weeks testing |
| | 10 | <5% black rust on sample after 8 weeks testing |
| | 30 | 5–10% black rust on sample after 8 weeks testing |
| | 45 | 5–30% black rust on sample after 8 weeks testing |

TABLE 2

| Passivation Temperature °C. | Contact Time | Corrosion resistance (in wet stack test @ 40° C.) |
|---|---|---|
| 50 | 2 | <5% black rust on sample after 8 weeks testing |
| | 4 | <5% black rust on sample after 8 weeks testing |
| | 10 | <5% black rust on sample after 8 weeks testing |
| | 30 | <5% black rust on sample after5 8 weeks testing |
| | 45 | 5–50% black rust on sample after 8 weeks testing |

TABLE 3

| Passivation Temperature °C. | Contact Time | Corrosion resistance (in wet stack test @ 40° C.) |
|---|---|---|
| 60 | 2 | <5% black rust on sample after 8 weeks testing |
| | 4 | <5% black rust on sample after 8 weeks testing |
| | 10 | <5% black rust on sample after 8 weeks testing |
| | 30 | <5% black rust on sample after 8 weeks testing |
| | 45 | <5% black rust on sample after 8 weeks testing |

EXAMPLE 2

Effect on Contact Time on Product Discolouration

The acidic treating solution was made according to Example 1 and the effects on various contact time on product discolouration is given in Table 4 and the results are plotted in FIG. 1.

TABLE 4

| Passivation Temperature | Contact Time | dL (lightness) |
|---|---|---|
| 40 | 2 | 82.28 |
| | 4 | 80.95 |
| | 10 | 75.79 |
| | 30 | 62.58 |
| | 45 | 62.24 |

With reference to FIG. 1, the X-axis represents the various contact time while the Y-axis represents the degree of discolouration wherein the greater value the lighter the appearance of the treated surface. As can be seen from FIG. 1, longer contact time for a phosphate/vanadate passivation treatment at 40° C. results in darker discolouration of the treated surface. As such, reduced contact time is preferred for minimum discolouration of the treated surface.

EXAMPLE 3

Effect on Vanadate Concentration on Passivation Efficiency

The acidic coating solution was made according to Example 1 except the vanadate concentration was varied. A metal coated steel strip was contacted for 4 seconds in the bath and the results are summarized in Table 5.

TABLE 5

| Passivation Temperature °C. | Vanadate Concentration (mol/L) | Corrosion resistance (in wet stack tests @ 40° C.) |
|---|---|---|
| 50 | 0.02 | up to 40% black rust within 2 weeks |
| | 0.04 | <5% black rust on sample after 8 weeks testing |
| | 0.04 | Insoluble precipitate formed |

EXAMPLE 4

Effect on Fluoride Concentration on Passivation Efficiency

The acidic coating solution was made according to Example 1 except the concentration of fluoride was varied. The contact time was 4 seconds and the passivation temperature was held constant at 30° C. The results are summarized in Table 6 below.

TABLE 6

| Fluoride Concentration (mol/L) | Corrosion resistance (in wet stack test @ 40° C.) |
|---|---|
| 0.017 | 10–20% blackening 5 weeks testing |
| 0.034 | <5% black rust on sample after 8 weeks testing |
| 0.068 | mild grey discolouration approximately 10% of sample |

EXAMPLE 5

Effect of Contact Time on Tungstate/Phosphate Passivation Efficiency

The acidic coating solution was made according to Example 1 except sodium tungstate (0.04M) was used in place of ammonium vanadate and the results are summarized in Table 7.

TABLE 7

| Contact Time (sec) | Corrosion resistance (in wet stack tests @ 40 C. |
|---|---|
| 2 | approx 10% black rust on sample after 8 weeks testing |
| 4 | approx 10% black rust on sample after 8 weeks testing |
| 10 | <10% black rust on sample after 8 weeks testing |
| 30 | approx 15% black rust on sample after 8 weeks testing |
| 45 | approx 50% black rust on sample after 8 weeks testing |

EXAMPLE 6

Comparison of Product Appearance of Phosphate, Molybdate/Phosphate, Tungstate/Phosphate, Vanadate/Phosphate and Chromate Systems The molybdate/phosphate, vanadate/phosphate and tungstate/phosphate solutions were prepared according to the general procedure of Example 1. The contact time was 2 to 4 seconds and the passivation temperature was held constant at 70° C. The results are summarized in Table 8.

TABLE 8

| Passivation solution | Results for 70° C. wet stack (4 weeks) |
|---|---|
| 1:1 (7.5M) $H_3PO_4$ | 5–10% grey staining on the samples 2–5 mm edge corrosion |
| 0.04M Mo<br>0.03M $F^-$<br>7.5M $H_3PO_4$ | 5–10% grey staining on the samples 3–5 mm edge corrosion |
| 0.04M W<br>0.03M $F^-$<br>7.5M $H_3PO_4$ | 2–10% grey staining on the samples 2–5 mm edge corrosion |
| 0.04M V<br>0.03M $F^-$<br>7.5M $H_3PO_4$ | 2–5% grey staining on the samples 1–3 mm edge corrosion |
| Chromate controls | removed after 1 week testing due to excessive black rust on surface |

Figure 2:
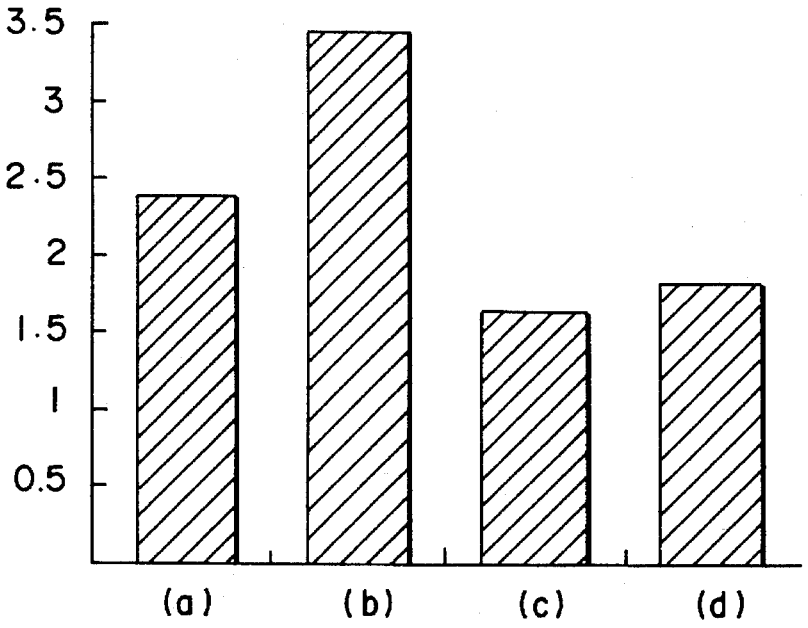
FIG. 2 shows the change in "yellowness" between the phosphate (a), molybdate/phosphate (b), vanadate/phosphate (c) and tungstate/phosphate (d) samples when compared to the unpassivated reference standard.

The passivation temperature of the samples in Example 6 was held constant at 30° C. with a contact time of 2 seconds and the solutions were prepared such that the pH was less than 1 and the results are illustrated in FIG. 2. With reference to FIG. 2, the ordinate shows the change in "yellowness" for various treatments indicated as follows on the co-ordinate axis:

(a)= phosphate (b)= molybdate/phosphate (c)= vanadate/phosphate (d)= tungstate/phosphate The dB readings are a delta (change) B between the sample and the unpassivated reference standard. Readings were taken with a McBeth 20.20 brand integrating sphere colour spectrophotometer and analysed using a hunter lab equation. FIG. 2 shows the lower yellow discolouration of the vanadate/phosphoric acid treatment compared with the others. The vanadate/phosphoric acid system has a further advantage when compared with the molybdate/phosphoric acid system in that the colour of the vanadate/phosphoric acid treated panels does not change with time whereas the molybdate/phosphoric acid treated panels have been seen to change from a pale yellow to a strong green colour when stored for periods up to 10 months.

EXAMPLE 7

Comparison of Corrosion Resistance of Phosphate, Molybdate/Phosphate, Vanadate/Phosphate, Tungstate/Phosphate and Chromate Systems The solutions of Example 6 were used to determine the corrosion resistance of various passivation systems at varying temperatures. In each case, the contact time was 2 seconds and the results are given below in Table 9 (samples passivated at 30° C.) and Table 10 (samples passivated at 50° C.).

TABLE 9

| Passivation system | Results after 7 weeks wet stack @ 40° C. |
|---|---|
| Phosphoric acid | 50–60% white corrosion product on surface some surface blackening also evident |
| Molybdate + phosphoric acid | No blackening evident |
| Vanadate + phosphoric acid | No blackening evident |
| Tungstate + phosphoric acid | Light/medium black blotches seen on up to 10% of sample surface |
| Chromate control | No corrosion evident |

TABLE 10

| Passivation system | Results after 7 weeks wet stack @ 40° C. |
|---|---|
| Phosphoric acid | Samples acceptable, but variable amounts of white corrosion product are evident on some surfaces |
| Molybdate + phosphoric acid | No blackening evident |
| Vanadate + phosphoric acid | No blackening evident |
| Tungstate + phosphoric acid | Samples acceptable with a few small (<2 mm) spots of black corrosion products evident |
| Chromate control | No corrosion evident |

Table 11 below contains the results of varying the concentration of phosphoric acid to 3M while maintaining a contact time of 2 seconds at a passivation temperature of 50° C.

TABLE 11

| Passivation system | Results after 2 weeks wet stack @ 40° C. |
|---|---|
| Phosphoric acid | Mild black rust evident over entire sample |
| Molybdate + phosphoric acid pH = 1.3 | Black rust evident on up to 30% of sample surface |
| Vanadate + phosphoric acid pH = 1.35 | No black rust evident |
| Chromate control | No black rust evident |

Substrates coated with the composition according to the present invention shows excellent anti corrosion properties and the long term prevention of rust as well as good adhesion of paint.

Although the invention has been described with reference to specific examples, it will be appreciated by those skilled in the art that the invention may be embodied in many other forms.

I claim:

1. An anti corrosion treatment of an aluminium or aluminium alloy surface comprising the steps of treating said surface with a solution having a pH of from greater than 0 to less than 2 and comprising at least one metal oxo ion complexed with phosphorus (V) wherein the metal oxo ion is vanadate or tungstate or a mixture thereof.

2. An anti corrosion treatment according to claim 1, wherein the solution further comprises at least one fluoride containing compound.

3. An anti corrosion treatment according to claim 2, wherein the fluoride containing compound is selected from the group consisting of sodium fluoride and sodium tetrafluoroborate.

4. An anti corrosion treatment according to claim 2, wherein the fluoride containing compound is present in a concentration of from 0.4 g/l to 1.5 g/l.

5. An anti corrosion treatment according to claim 4, wherein the concentration is from 0.4 g/l to 0.7 g/l.

6. An anti corrosion treatment according to claim 1, wherein the metal oxo ion is vanadate.

7. An anti corrosion treatment according to claim 6, wherein the vanadate is present in a concentration from 10 g/l to 100 g/l.

8. An anti corrosion treatment according to claim 7, wherein the concentration is from 10 g/l to 60 g/l.

9. An anti corrosion treatment according to claim 1, wherein the pH range is from 1 to 1.5.

* * * * *